US005284465A

United States Patent [19]

Homan, Jr.

[11] Patent Number: 5,284,465

[45] Date of Patent: Feb. 8, 1994

[54] APPARATUS FOR USE IN DOING SQUAT EXERCISES

[76] Inventor: Paul T. Homan, Jr., 7311 E. 89th Pl. South, Tulsa, Okla. 74133

[21] Appl. No.: 10,475

[22] Filed: Jan. 28, 1993

Related U.S. Application Data

[63] Continuation of Ser. No. 826,861, Jan. 28, 1992, abandoned.

[51] Int. Cl.[5] ..... A63B 21/00

[52] U.S. Cl. ..... 482/148; 482/79

[58] Field of Search ..... 482/51, 79, 80, 92, 482/95, 96, 148, 121-130; 297/438, 439

[56] References Cited

U.S. PATENT DOCUMENTS

| | | | |
|---|---|---|---|
| 1,801,769 | 4/1931 | Gartner | 482/79 X |
| 2,654,420 | 10/1953 | Rogers | 297/438 X |
| 2,926,911 | 3/1960 | Reichel | 482/128 X |
| 3,005,662 | 10/1961 | Emery | 297/438 |
| 3,297,320 | 1/1967 | Benedetto | 481/79 X |
| 3,598,404 | 8/1971 | Bowman | 482/80 |
| 3,641,601 | 2/1972 | Sieg | 482/121 X |
| 3,741,540 | 6/1973 | Shimizu | 482/128 X |
| 3,787,049 | 1/1974 | Rellinger . | |
| 4,114,613 | 9/1978 | Kuhn | 482/97 X |
| 4,279,415 | 7/1981 | Katz | 482/90 X |
| 4,429,868 | 1/1984 | LeBlanc et al. . | |
| 4,441,758 | 4/1984 | Fleischer et al. | 297/439 |
| 4,452,449 | 6/1984 | Propst | 482/79 X |
| 4,561,649 | 12/1985 | Forsythe . | |
| 4,603,851 | 8/1986 | Russell | 482/79 |
| 4,678,234 | 7/1987 | Wilson | 297/439 |
| 4,679,550 | 7/1987 | Quam et al. | 482/79 X |
| 4,693,470 | 9/1987 | Ogawa | 482/79 X |
| 4,951,938 | 8/1990 | Smith, IV . | |

FOREIGN PATENT DOCUMENTS

| | | | |
|---|---|---|---|
| 2145884 | 4/1980 | Fed. Rep. of Germany | 482/79 |
| 645932 | 11/1928 | France | 297/439 |

*Primary Examiner*—Robert Bahr

*Attorney, Agent, or Firm*—Head & Johnson

[57] ABSTRACT

An apparatus for use by a person to do squat exercises that emphasizes substantially the full range of upper leg muscle groups while alleviating the pressure that concentrates in the lower back, the apparatus being in the form of an inclined elongated platform having a bottom surface that rests on a floor and an upper surface supported above and in close proximity to the bottom surface at an inclined angle of about 11 to 21 degrees, the platform having a width sufficient to permit the user to place at least a portion of both feet thereon with the user's legs spaced apart.

17 Claims, 2 Drawing Sheets

APPARATUS FOR USE IN DOING SQUAT EXERCISES

This is a continuation of copending application Ser. No. 07/826,861 filed on Jan. 28, 1992, now abandoned.

BACKGROUND OF THE INVENTION

Regimented exercise routines have long been utilized by athletes as a part of their athletic training. In recent times, however, physical fitness has become important not only to athletes but to the general population. The health and emotional benefits from good physical conditioning have been well documented, and for this reason today more people than ever before are interested in innovative exercise routines and proper exercise equipment.

One basic exercise that has long been used by the professional athlete and that is now in common use by the general public for strengthening, conditioning and toning muscles is the basic squat exercise. The typical way in which this exercise has been performed is for the person to stand with both feet flat on a floor surface with the feet spaced shoulder width apart and directly underneath the person's torso. Upon initial execution of the squat exercise the knees are slightly bent while maintaining the body in a substantially erect position. During decent the elevation of the torso is reduced toward the floor level until the bottom position is reached. The legs are then straightened to raise the torso back to the original position.

Another basic exercise used by the professional athlete and now in common use by the general public is to strengthen and stretch the lower leg muscles and Achilles Tendon. This is done by performing "calve raises" and "calve stretches". Calve raises strengthen and stretch the lower leg muscles and are performed with the person standing erect with feet flat on a surface. The heels are raised contracting the calve muscles. The heels are then lowered to the original position.

Calve stretches are typically performed with feet flat and spaced shoulder width apart and on a flat surface. The bottom of the feet remain flat on a surface while the knees are bent and lowered in order to stretch the Achilles Tendon and lower leg muscles.

A problem associated with the squat exercise when performed by a person standing on a flat surface is that it tends to concentrate stress on the person's lower back, that is, in the Erector Spinae muscle group. The pressure concentrates in the lower back due to the excessive forward lean of the back needed to stabilize the body during the squat exercise. Since lower back injuries are a common problem of modern society, any exercise that overly concentrates on this area of the user's muscle group is usually considered deleterious to the overall exercise program.

An object of this invention is to provide a wedge shaped member for use by a person doing squat exercises to improve the development of the major leg, buttocks, and hip muscle groups, while minimizing the stress on the person's lower back muscle groups.

Another object of this invention is to provide an inexpensive, portable and easy to use apparatus designed to position the user's body in a less strenuous state during execution of the squat exercise thereby reducing the pressure that concentrates in the lower back and minimizing the risk of lower back injury.

Another object of this invention is to provide an apparatus that can be used to enhance the physical fitness of the user by improving overall leg muscle strength and conditioning through one exercise.

Still another object of this invention is to stretch and strengthen the lower leg muscle groups and the Achilles Tendon.

SUMMARY OF THE INVENTION

This invention is an apparatus for use by a person to do squat exercises. The apparatus is constructed in such a way that by its use a squat exercise program emphasizes substantially the full range of upper leg muscle groups, while alleviating the pressure that normally concentrates in the lower back during execution of the squat exercise performed in the conventional way. The design of the apparatus allows the user to perform the squat exercise while keeping the user's back erect.

The apparatus is a portable, inclined elongated platform having a bottom surface configured to rest on a floor, and an upper surface. The upper surface is supported above and in close proximity to the bottom surface and at an acute angle to the bottom surface in the range of about 11 to 21 degrees.

The platform has a length sufficient to permit a user to place at least a portion of both feet thereon, with the user's legs spaced shoulder width apart. The platform upper surface has a width sufficient for a substantial portion of both feet thereon, that is, the width is such to permit the user to place at least the heel portions of both feet thereon or the user may place the ball portions of both feet thereon.

In a preferred embodiment, the apparatus for use by a person to do squat exercises is constructed of a formed plastic part bent along a fold edge so that an upper and a lower portion is formed. The bottom surface is the bottom surface of the lower portion and the upper surface is the upper surface of the upper portion. Bending of the rectangular sheet of plastic is preferably carried out in such a way as to produce, at the conjunction of the lower and upper portion, an integral arcuate nose portion at the fold line arranged such that in typical uses of the devise the user's arch portion of each foot is above the nose portion of the apparatus. Rather than be formed of a sheet of plastic, the apparatus may be manufactured either by injection or blow molding.

A better understanding of the invention will be obtained from reference to the following description of the preferred embodiment, taken in conjunction with the attached drawings.

DESCRIPTION OF THE DRAWINGS

FIG. 5 shows the person doing a squat exercise in the mid position of a properly performed squat exercise.

DESCRIPTION OF THE PREFERRED EMBODIMENT

Figure 1:
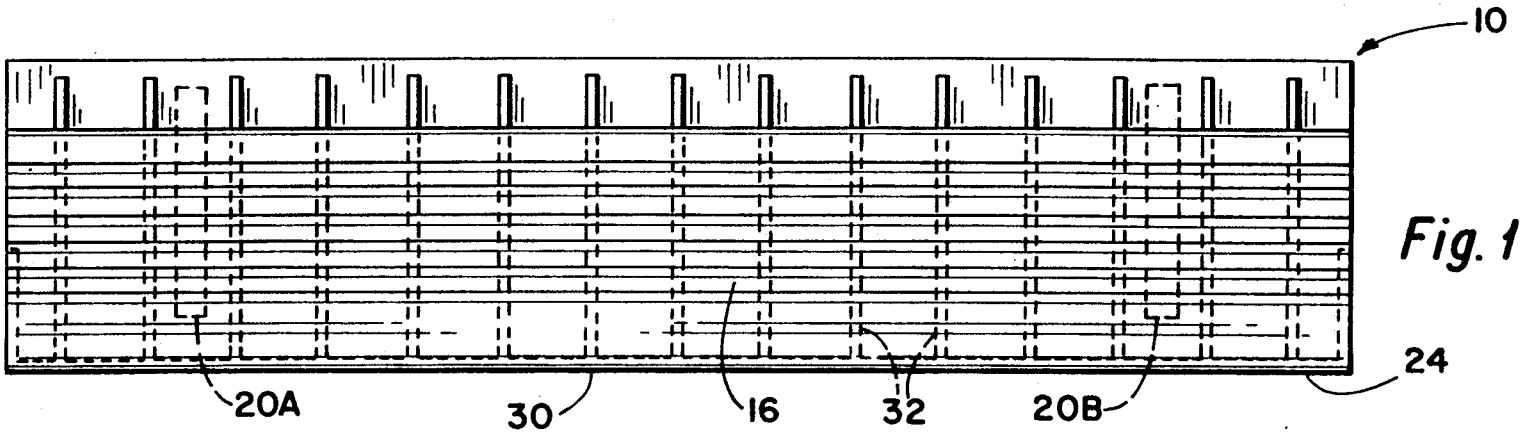
FIG. 1 is a top plane view of an apparatus for use by a person to do squat exercises incorporating the principles of this invention.
Figure 2:
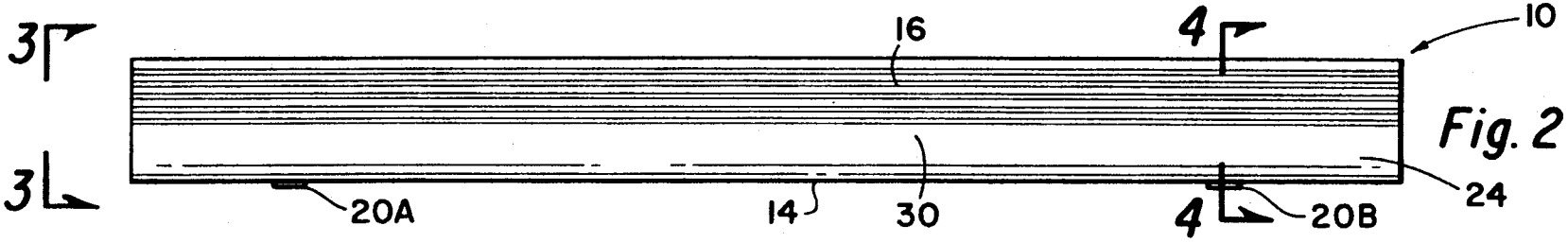
FIG. 2 is a front elevational view of the apparatus of FIG. 1.
Figure 4:
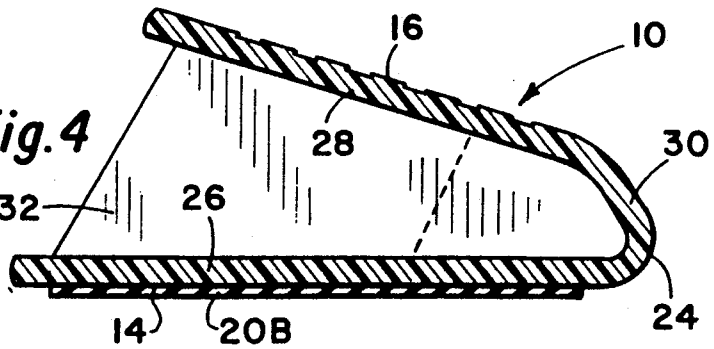
FIG. 4 is a cross-sectional view taken in a plane perpendicular to the length of the apparatus along the line 4—4 of FIG. 2.
Figure 3:
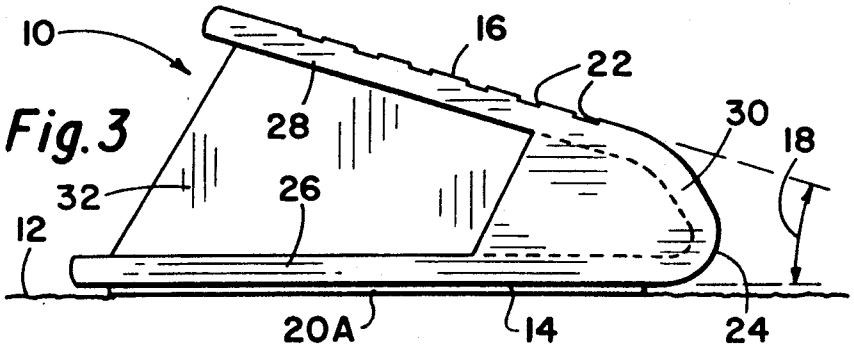
FIG. 3 is an end view taken along the line 3—3 of FIG. 2 of the apparatus.

Referring to the drawings and first to FIGS. 1 through 4, an apparatus for use by a person to do squat exercises that incorporates the principles of this invention is illustrated. The apparatus is generally indicated by the numeral 10 and is intended for use on floor surface 12, as seen in FIG. 3. The basic elements of the apparatus is a bottom surface 14 configured to rest on floor surface 12 and an upper surface 16. The upper surface 16 is supported above and in close proximity to bottom surface 14 and at an acute angle to the bottom surface. The acute angle, indicated by the numeral 18 in FIG. 3, is preferably in the range of about 11 to 21 degrees with an angle of 16 degrees being considered ideal, however, it is not intended that the invention be limited to such ideally determined angle, since further experimentation may determine that some other angle within the range may be advantageous. At the time of this writing the preferred angle 18 is about 16 degrees.

As seen in FIGS. 1 and 2, apparatus 10 is elongated, that is, it has a length several times its width, with a length of about 2½ feet being considered ideal so that the device is easily portable and adaptable to various user feet positions so to allow unlimited stance variations. However, the apparatus obviously can be much longer, such as 3 or 4 feet in length if desired. The length of the apparatus must be that which is sufficient to permit the user to place both feet on upper surface 16, with the user's legs spaced at least shoulder width apart. Variations in the stance will isolate different muscle groups and the stress imposed on the specific muscle groups. The user is encouraged to experiment with variations in stance in order to determine a stance that best improves muscle development.

The apparatus preferably includes a skid resistance means, such as elastomeric strips 20A and 20B as seen in FIG. 2. The strips rest on floor surface 12, only strip 20A being seen in FIG. 3. A greater number of such elastomeric strips may be used if desired, such as three with one in the middle between 20A and 20B.

The upper surface 16 is preferably of a non-slip configuration and this can be achieved in a variety of ways. In one way (not illustrated) a non-slip material may be bonded to upper surface 16. In the manner illustrated, the upper surface is provided with spaced apart grooves 22 integrally formed in the upper surface, the grooves extending parallel to each other and the full length of the apparatus.

The apparatus as illustrated in FIGS. 1 through 4 may be formed in a variety of ways. In the embodiment as illustrated, the apparatus is constructed of a formed plastic part that is folded along a fold line 24 to provide a lower portion 26 and an integral upper portion 28. The bottom surface 14 is the bottom surface of the lower portion 26 and the upper surface 16 is the upper surface of upper portion 28.

In forming the plastic part to make the integral lower and upper portions 26 and 28, fold line 24 is preferably arranged so that the fold line produces an integral arcuate nose portion 30. A wedge can be constructed in such a way that it does not employ an integral arcuate nose portion 30, such as a sharp wedge, if the dash lines used to indicate angle 30 are continued to a point of interception. However, the provision of an arcuate nose portion 30 integrally interconnecting the apparatus lower and upper portions 26 and 28 is preferred for reasons which will be described subsequently.

In the making of the apparatus as illustrated in FIGS. 1 through 4 out of a formed plastic part folded about a fold line 24, a plurality of wedges 32 are employed and are spaced apart and paralleled to each other within the space between the lower and upper portions 26 and 28. Wedges 32 are preferably formed of plastic material, such as the same as that which the integral folded lower and upper portions 26 and 28 is made so that the wedges are easily integrally bonded or molded in position. The wedges 32 serve to support the weight of the user and prevent upper portion 28 from flexing with respect to lower portion 26.

Rather than form the apparatus as described with respect to FIGS. 1 through 4 it may be injection molded or blow molded as an integral unit.

Figure 5:
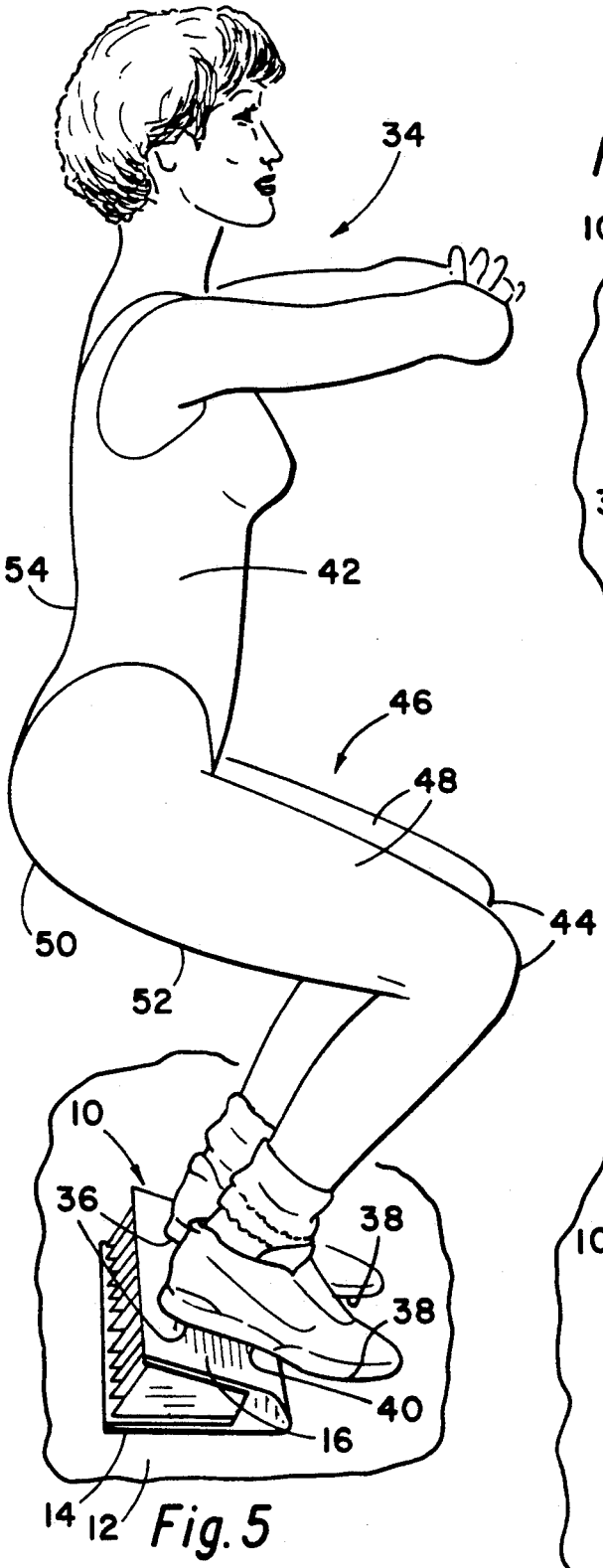
FIG. 5 is an isometric view of the apparatus of this invention showing its use by a person to do squat exercises.
Figure 6:
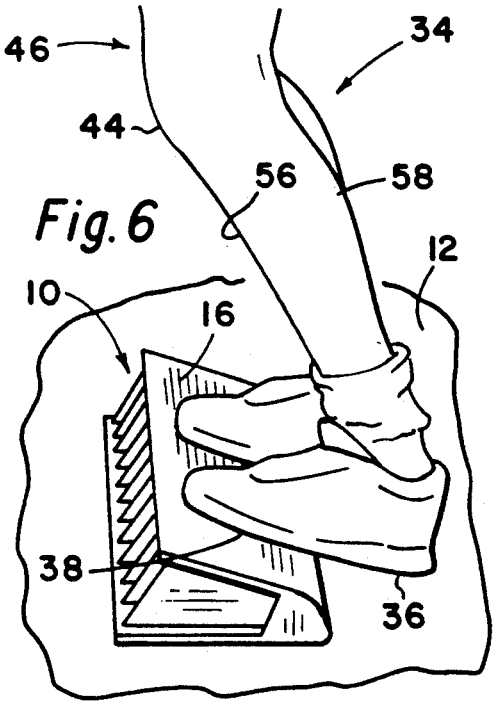
FIG. 6 shows the device being used to stretch and strengthen the lower leg muscle groups and Achilles Tendon.
Figure 7:
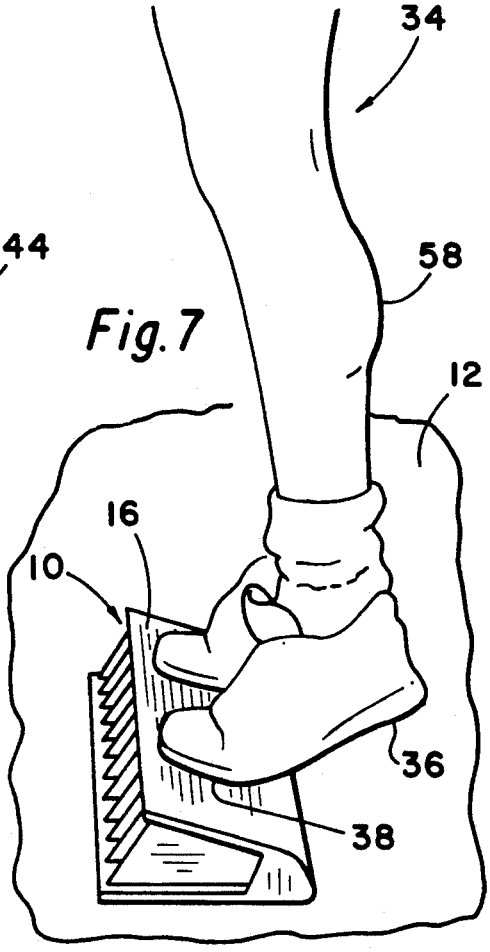
FIG. 7 shows the lower leg of a person performing calve raises whereby the calves are contracted by raising the person's torso to the maximum elevation above the apparatus.

Referring to FIGS. 5, 6 and 7, the method of utilizing the apparatus for use by a person to do squat exercises is illustrated. FIG. 5 shows one method of using the apparatus. A person 34 is shown with her heels 36 of both feet resting upon the apparatus upper surface 16, the apparatus resting on floor surface 12. The ball portions 38 of the person's feet extend beyond the apparatus nose portion 30 to touch floor surface 12. This places the person's arch 40 generally over the apparatus nose portion 30.

The apparatus is used by person 34 standing upright with the person's torso 42 directly above apparatus 10 and with the person's legs slightly bent. Person 34 then flexes her/his knees 44 to reduce the elevation of torso 42 while keeping it straight, with the weight supported above the person's feet. In FIG. 5, person 34 has reached a middle position or half-squat position. The downward elevational positioning of the torso is continued to the bottom position (not shown) in which the person's upper legs 46 are just above parallel to floor surface 12. It is not generally recommended that the squat exercise be carried out beyond the point where the upper legs are parallel to the floor. The user can adjust the degree of decent dependent upon the strength and flexibility of the individual's hips, knees, and legs. After reaching the bottom position person 34 flexes her/his knees 44 in the opposite direction, elevationally positioning the torso and passing back again through the position shown in FIG. 5 and then to the full upright position (not shown). This sequence can then be repeated as often as desired. In some exercises the middle position, as shown in FIG. 5, or the bottom position is held for a certain count before the exercise is continued. Correct execution of each step is crucial in producing a strong, fluid, and mechanically effective squat movement.

The exercises illustrated in FIG. 5 are particularly useful in strengthening the quadriceps, that is, the muscle groups that include the Vastus Laterails, Vastus Intermedius, Vastus Medialis, and Vastus Femoris. In addition, the muscles of the gluteus maximums 50 and the hamstring muscles 52, that is, the Semimembranosus, Semitendinosus and Biceps Femoris are strengthened.

The use of apparatus 10 reduces the tension on the lower back muscles, that is, the Erector Spinae 54, usually associated with doing squat exercises while standing on a flat floor surface 12. More particularly, the use of apparatus 10 concentrates the exercise into the muscle groups specifically identified, that is, quadriceps 48, gluteus maximums 50 and hamstrings 52 without increasing the stress on lower back 54.

FIGS. 6 and 7 show alternate methods of utilizing apparatus 10. In both methods, user stands with ball portion 38 and toes of each foot on the apparatus upper surface 16. The heel portions 36 can be in contact with floor surface 12 when the exercise is initiated. Using the apparatus as shown in FIG. 6 wherein the person's feet ball portions and toes are on upper surface 16 the person moves the knees forward to stretch the lower leg muscles, including the Tibialis Anterior muscle group 56 that run along the front of the leg below the knee, calves 58, that is, the Gastrocnemius and Soleus, and Achilles Tendon. FIG. 7 shows an additional means of using the arrangement of FIG. 6 wherein the user 34, in an erect position, raises her/his heels to stand momentarily entirely upon the apparatus upper surface 16 to contract calve muscles 58. After reaching and momentarily holding the position as illustrated FIG. 7, the user can lower her/his heels 36 back to floor surface 12, as shown in FIG. 6. Repeating this movement strengthens and stretches the calve muscles and Achilles Tendon.

The apparatus described herein is a highly useful, portable and inexpensive way of substantially improving the exercise benefits to be gained from the basic squat exercise to increase the desirable muscle tension action on the major leg muscle groups, while minimizing the stress applied to the user's lower back muscle groups. Another function of the apparatus is to strengthen and stretch the lower leg muscle groups and Achilles Tendon.

The claims and the specification describe the invention presented and the terms that are employed in the claims draw their meaning from the use of such terms in the specification. The same terms employed in the prior art may be broader in meaning than specifically employed herein. Whenever there is a question between the broader definition of such terms used in the prior art and the more specific use of the terms herein, the more specific meaning is meant.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. Apparatus adapted to be supported on a floor surface and arranged to position a user's body in a less strenuous state during execution of the squat exercise that emphasizes substantially the full range of upper leg muscle groups while alleviating the pressure that concentrates in the lower back or for strengthening and stretching the lower leg muscles and Achilles Tendon, comprising:

an inclined elongated platform having a bottom surface supported on the floor surface and an upper surface, the upper surface being supported above and in close proximity to the bottom surface at a fixed acute angle to the bottom surface in the range of about 11 to 21 degrees, the platform having a length sufficient to permit a user to place at least a portion of both feet thereon with the user's legs spaced apart, and the upper surface having a width sufficient for the user placing at least a portion of both feet thereon, said inclined platform being constructed of a single flat sheet of material folded in a short radius arc along a rigid fold line to form a unitary horizontal lower portion and an integral inclined upper portion, the lower portion having a bottom surface forming said platform bottom surface for resting on the floor surface and the upper portion having an upper surface forming said platform upper surface in a fixed plane above the floor surface.

2. An apparatus for use in doing squat exercises according to claim 1 including:

skid resistance means secured to said inclined platform bottom surface.

3. An apparatus for use in doing squat exercises according to claim 1 wherein said platform upper surface includes skid resistance means.

4. An apparatus for use in doing squat exercises according to claim 3 wherein said platform upper surface has longitudinal grooves therein forming said skid resistance means.

5. An apparatus for use in doing squat exercises according to claim 1 including a plurality of spaced apart wedge shaped structural members positioned between said lower portion and said integral upper portion.

6. An apparatus for use in doing squat exercises according to claim 5 wherein said formed single part is of plastic material and said wedge shaped structural members are of plastic material bonded to said lower and integral upper portions.

7. An apparatus for use in doing squat exercises according to claim 1 wherein said formed single part is of plastic material.

8. An apparatus for use in doing squat exercises according to claim 1 wherein said fold line at which said lower portion and said upper portion integrally join is, in cross-sections taken perpendicular the length thereof, of arcuate configuration providing an integral nose portion integrally joining said lower and upper portions.

9. An apparatus for use in doing squat exercises according to claim 1 wherein said elongated platform has a length that is several times its width.

10. An apparatus for use in doing squat exercises according to claim 1 wherein said elongated platform has a length of at least about two and one-half feet.

11. Apparatus for use on a floor surface to position a user's body in a less strenuous state during execution of the squat exercise that emphasizes substantially the full range of upper leg muscle groups while alleviating the pressure that concentrates in the lower back or for strengthening and stretching the lower leg muscles and Achilles Tendon and which permits the use of both the ball and heel portion of each foot of the user in doing squat exercises, comprising:

an elongated platform having a horizontal bottom surface resting on the floor surface and an inclined upper surface, the upper surface being supported above and in close proximity to said bottom surface at a fixed acute angle to said bottom surface in the range of about 11 to 21 degrees, said platform upper surface having a length sufficient to permit a user to place a portion of both feet thereon with the user's legs spaced apart, said bottom surface and said upper surface merging in a short radius arcuate nose portion extending the length of said platform, said nose portion being of short vertical height, said upper surface being thereby spaced closely to the floor surface whereby a user may place the ball portion of each foot on said upper surface and concurrently the heel portion of each foot on the floor surface or the user may place the heel portion of each foot on said upper surface and the ball portion of each foot on the floor surface while doing squat exercises, the platform being formed of a single flat sheet of material folded along a rigid fold line to form a horizontal lower portion having a bottom surface thereon for resting on the floor surface and an inclined integral upper portion having said upper surface thereon in a fixed plane above said floor surface, the fold line forming said arcuate nose portion.

12. An apparatus for use in doing squat exercises according to claim 11 including:

skid resistance means secured to said inclined platform bottom surface.

13. An apparatus for use in doing squat exercises according to claim 11 wherein said platform upper surface includes skid resistance means.

14. An apparatus for use in doing squat exercises according to claim 13 wherein said platform upper surface has longitudinal grooves therein forming said skid resistance means.

15. An apparatus for use in doing squat exercises according to claim 11 including a plurality of wedge shaped members positioned between said lower portion and said integral upper portion.

16. An apparatus for use in doing squat exercises according to claim 11 wherein said formed single part is of plastic material.

17. An apparatus for use in doing squat exercises according to claim 16 wherein said formed single part is of plastic material and said wedge shaped members are of plastic material bonded to said lower and upper portions.

* * * * *